US009801409B1

(12) United States Patent
Smith

(10) Patent No.: US 9,801,409 B1
(45) Date of Patent: Oct. 31, 2017

(54) MOIST SNUFF COMPOSITIONS AND METHODS OF MAKING AND USING SAME

(71) Applicant: Jerry Wayne Smith, Advance, NC (US)

(72) Inventor: Jerry Wayne Smith, Advance, NC (US)

(73) Assignee: Jerry Wayne Smith, Advance, NC (US)

( * ) Notice: Subject to any disclaimer, the term of this patent is extended or adjusted under 35 U.S.C. 154(b) by 307 days.

(21) Appl. No.: 14/496,724

(22) Filed: Sep. 25, 2014

(51) Int. Cl.
*A24B 15/16* (2006.01)
*A24B 15/18* (2006.01)
*A24B 13/00* (2006.01)

(52) U.S. Cl.
CPC ..... *A24B 15/16* (2013.01); *A24B 13/00* (2013.01); *A24B 15/18* (2013.01)

(58) Field of Classification Search
CPC ..... A24B 15/16
See application file for complete search history.

(56) References Cited

U.S. PATENT DOCUMENTS 2,895,829 A * 7/1959 Feo ..... A23K 50/90 426/1
4,761,285 A * 8/1988 Vasiliou ..... A61K 36/48 424/539
6,544,581 B1 4/2003 Shrikhande et al.
8,047,209 B2 11/2011 May, Jr.
8,272,388 B2 9/2012 Calandro et al.
2008/0317911 A1* 12/2008 Schleef ..... A24B 13/00 426/103
2013/0142881 A1* 6/2013 Odom ..... A61K 35/644 424/537

FOREIGN PATENT DOCUMENTS

WO WO 8402719 A1 * 7/1984 ..... C12G 3/06

OTHER PUBLICATIONS

Koerber, Humectants and Water Activity, downloaded online Oct. 5, 2016, Aqua Lab.*
Kuney et al., Phase Feeding of Layers, Aug. 1980, Progress in Poultry, No. 22.*
Vashisth Tripti, Evaluation of Drying Technologies for Muscadine Pomace to Produce an Antioxidant Rich Functional Food Ingredient, 2009, University of Georgia.*
Sigma-Aldrich, Particle Size Conversion Table, downloaded online Jan. 26, 2017.*
Di Pasquale et al., Influence of Pollen Nutrition on Honey Bee Health:Do Pollen Quality and Diversity Matter?, Aug. 2013, PloS One, 8(8):e72016.*
BeeMaster, Feeding Fresh Brown Sugar to Bees, Jan. 2009.*
Brallet, Nutraceutical Properties of the Muscadine Grape (Vitis Rotundifola), Sorghum bicolor, and Polygonum Cuspidatum, 2007, UGA Thesis.*

(Continued)

*Primary Examiner* — Anthony Calandra
(74) *Attorney, Agent, or Firm* — Myers Bigel, P.A.

(57) ABSTRACT

The present invention provides moist snuff compositions and methods of making and using the same. In some embodiments, the present invention provides moist snuff compositions comprising grape tissue and a humectant, wherein the grape tissue comprises ground grape skins, ground grape pulp and/or ground grape seeds.

28 Claims, 1 Drawing Sheet

(56) References Cited

OTHER PUBLICATIONS

Ghanim et al., "A Resveratrol and Polyphenol Preparation Suppresses Oxidative and Inflammatory Stress Response to a High-Fat, High-Carbohydrate Meal", *The Journal of Clinical Endocrinology and Metabolism*, 2011, 96(5): 1409-1414.
God et al., "Anticancer Effects of Four Varieties of Muscadine Grape", *Journal of Medicinal Food*, 2007, 10(1): 54-59.
Gourineni et al., "Muscadine Grape (*Vitis rotundifolia*) and Wine Phytochemicals Prevented Obesity-Associated Metabolic Complications in C57BL/6J Mice", *Journal of Agricultural and Food Chemistry*, 2012, 60(31): 7674-7681.
Greenspan et al., "Antiinflammatory Properties of the Muscadine Grapes (*Vitis rotundifolia*)", Journal of Agricultural and Food Chemistry, 2005, 53(22): 8481-8484.
Hudson et al., "Inhibition of Prostate Cancer Growth by Muscadine Grape Skin Extract and Resveratrol through Distinct Mechanisms", *Cancer Research*, 2007, 67(17): 8396-8405.
Lee et al., "Identification of Ellagic Acid Conjugates and Other Polyphenolics in Muscadine Grapes by HPLC-ESI-MS", *Journal of Agricultural and Food Chemistry*, 2005, 53(15): 6003-6010.
Mellen et al., "Effect of Muscadine Grape Seed Supplementation on Vascular Function in Subjects with or at Risk for Cardiovascular Disease: A Randomized Crossover Trial", *Journal of the American College of Nutrition*, 2010, 29(5): 469-475.
Mertens-Talcott et al., "Induction of Cell Death in Caco-2 Human Colon Carcinoma Cells by Ellagic Acid Rich Fractions from Muscadine Grapes (*Vitis rotundifolia*)", *Journal of Agricultural and Food Chemistry*, 2006, 54(15): 5336-5343.
Nicoletti et al., "Identification and Quantification of Phenolic Compounds in Grapes by HPLC-PDA-ESI-MS on a Semimicro Separation Scale", *Journal of Agricultural and Food Chemistry*, 2008, 56(19): 8801-8808.
Noratto et al., "Polyphenolics from Açal (*Euterpe oleracea* Mart.) and Red Muscadine Grape (*Vitis rotundifolia*) Protect Human Umbilical Vascular Endothelial Cells (HUVEC) from Glucose- and Lipopolysaccharide (LPS)-Induced Inflammation and Target MicroRNA-126", *Journal of Agricultural and Food Chemistry*, 2011, 59(14): 7999-8012.
O'Connor et al., "Resveratrol Inhibits Periodontal Pathogens In Vitro", *Phytotherapy Research*, 2011, 25(11): 1727-1731.
Pastrana-Bonilla et al., "Phenolic Content and Antioxidant Capacity of Muscadine Grapes", *Journal of Agricultural and Food Chemistry*, 2003, 51(18): 5497-5503.
Sandhu et al., "Antioxidant Capacity, Phenolic Content, and Profiling of Phenolic Compounds in the Seeds, Skin, and Pulp of *Vitis rotundifolia* (Muscadine Grapes) as Determined by HPLC-DAD-ESI-$MS^n$", *Journal of Agricultural and Food Chemistry*, 2010, 58(8): 4681-4692.
Shi et al., "Polyphenolics in Grape Seeds—Biochemistry and Functionality", *Journal of Medicinal Food*, 2003, 6(4): 291-299.
Tallant et al., "Inhibition of cancer cell growth by muscadine grape seed and grape skin extracts", Abstract, *102nd Annual Meeting of the American Association for Cancer Research*, Apr. 5, 2011.
Yi et al., "Study of Anticancer Activities of Muscadine Grape Phenolics in Vitro", *Journal of Agricultural and Food Chemistry*, 2005, 53(22): 8804-8812.
Yilmaz et al., "Major Flavonoids in Grape Seeds and Skins: Antioxidant Capacity of Catechin, Epicatechin, and Gallic Acid", *Journal of Agricultural and Food Chemistry*, 2004, 52(2): 255-260.
You et al., "Analysis of Phenolic Composition of Noble Muscadine (*Vitis rotundifolia*) by HPLC-MS and the Relationship to Its Antioxidant Capacity", *Journal of Food Science*, 2012, 77(10): C1115-C1123.
You et al., "Inhibitory Effects of Muscadine Anthocyanins on α-Glucosidase and Pancreatic Lipase Activities", *Journal of Agricultural and Food Chemistry*, 2011, 59(17): 9506-9511.

* cited by examiner

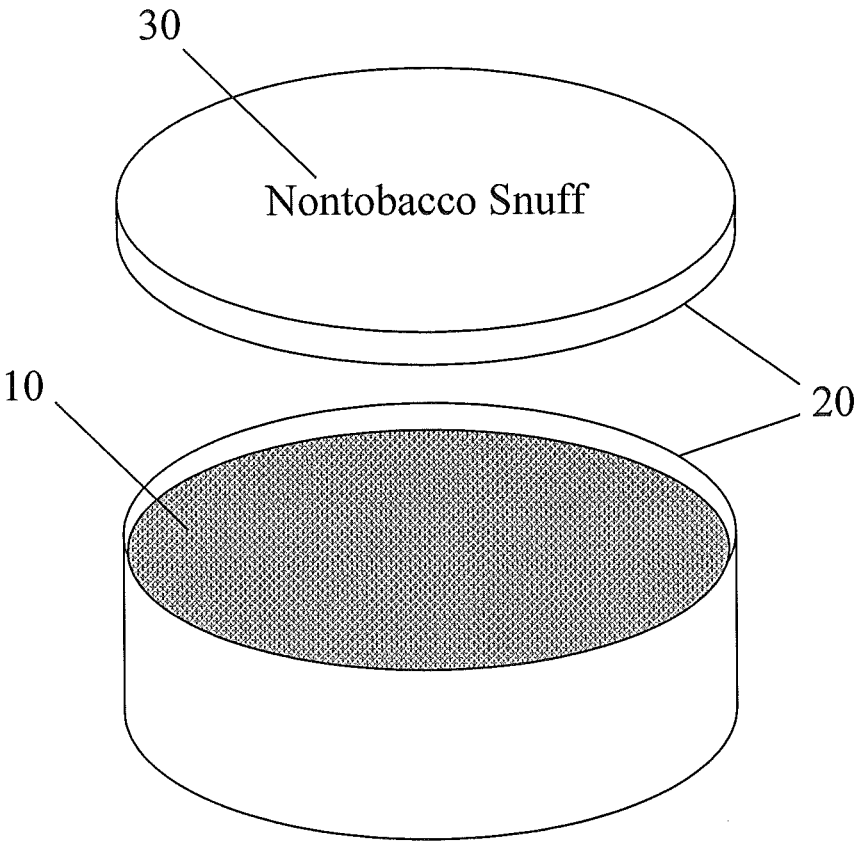
30
Nontobacco Snuff
10
20

MOIST SNUFF COMPOSITIONS AND METHODS OF MAKING AND USING SAME

FIELD OF THE INVENTION

The present invention relates to moist snuff compositions and methods of making and using the same.

BACKGROUND OF THE INVENTION

The harmful health effects of tobacco use/consumption have been well-documented and widely publicized. Nevertheless, and despite the prevalence of non-tobacco "substitutes," many individuals continue to use/consume smokeless tobacco products such as chewing tobacco and moist snuff. There is thus a need for compositions having a taste and texture comparable to smokeless tobacco products without the harmful side effects associated therewith.

SUMMARY OF THE INVENTION

A first aspect of the present invention is a moist snuff composition comprising grape tissue and a humectant. The grape tissue comprises tissue from grape skins, grape pulp and/or grape seeds. The humectant may comprise honey and/or molasses.

A second aspect of the present invention is a method of producing a moist snuff composition, the method comprising combining ground grape tissue and a humectant. The grape tissue comprises ground grape skins, ground grape pulp and/or ground grape seeds. The humectant comprises honey and/or molasses.

BRIEF DESCRIPTION OF THE DRAWINGS

The following drawing forms part of the present specification and is included to further demonstrate certain aspects of the present invention. The invention may be better understood by reference to the following drawing in combination with the detailed description of specific embodiments presented herein. The drawing is not necessarily drawn to actual or relative scale, emphasis instead being placed upon illustrating certain aspects of the present invention.

FIG. 1 is a schematic diagram of a moist snuff composition in a canister according to some embodiments of the present invention. The canister is shown with the lid removed.

DETAILED DESCRIPTION OF EMBODIMENTS OF THE INVENTION

The foregoing and other aspects of the present invention will now be described in more detail with respect to compositions and methodologies provided herein.

This description is not intended to be a detailed catalogue of all the ways in which the present invention may be implemented or of all the features that may be added to the present invention. For example, features illustrated with respect to one embodiment may be incorporated into other embodiments, and features illustrated with respect to a particular embodiment may be deleted from that embodiment. Thus, one or more of the method steps included in a particular method described herein may, in other embodiments, be omitted and/or performed independently. In addition, numerous variations and additions to the embodiments suggested herein, which do not depart from the instant invention, will be apparent to those skilled in the art in light of the instant disclosure. Hence, the following description is intended to illustrate some particular embodiments of the invention, and not to exhaustively specify all permutations, combinations and variations thereof. It should therefore be appreciated that the present invention is not limited to the particular embodiments set forth herein. Rather, these particular embodiments are provided so that this disclosure will convey the full scope of the invention to those skilled in the art.

The terminology used herein is for the purpose of describing particular embodiments of the present invention only and is not intended to limit the present invention.

Although the following terms are believed to be well understood by one of skill in the art, the following definitions are set forth to facilitate understanding of the presently disclosed subject matter.

All technical and scientific terms used herein, unless otherwise defined below, are intended to have the same meaning as commonly understood by one of ordinary skill in the art. References to techniques employed herein are intended to refer to the techniques as commonly understood in the art, including variations on those techniques or substitutions of equivalent techniques that would be apparent to one of skill in the art.

As used herein, the terms "a" or "an" or "the" may refer to one or more than one unless the context clearly and unequivocally dictates otherwise. For example, unless the context dictates otherwise, "a" muscadine grape may refer to one muscadine grape or a plurality of muscadine grapes.

As used herein, the term "about," when used in reference to a measurable value such as an amount of mass, dose, time, temperature, and the like, refers to a variation of 0.1%, 0.25%, 0.5%, 0.75%, 1%, 2%, 3%, 4%, 5%, 6,%, 7%, 8%, 9%, 10%, 15% or even 20% of the specified amount. For example, if a given composition is described as comprising "about 50% X," it is to be understood that, in some embodiments, the composition comprises 50% X, whilst in other embodiments it may comprise anywhere from 40 to 60% X (i.e., 50±10%).

As used herein, the term "and/or" refers to and encompasses any and all possible combinations of one or more of the associated listed items, as well as the lack of combinations when interpreted in the alternative ("or").

As used herein, the terms "comprise," "comprises," "comprising," "include," "includes" and "including" specify the presence of stated features, integers, steps, operations, elements, and/or components, but do not preclude the presence or addition of one or more other features, integers, steps, operations, elements, components, and/or groups thereof.

As used herein, the term "consists essentially of" (and grammatical variants thereof), as applied to the compositions and methods of the present invention, means that the compositions/methods may contain additional components so long as the additional components do not materially alter the composition/method. The term "materially alter," as applied to a composition/method of the present invention, may refer to an increase or decrease in one or more characteristics of the composition/method of at least about 20% or more. For example, a component added to a composition of the present invention may be deemed to "materially alter" the composition if it increases or decreases the moisture content of the composition by at least 20%. Likewise, an additional step added to a method may be deemed to "materially alter" the method, if it increases or decreases the concentration of one or more phytochemicals (e.g., one or more antioxidant phytochemicals) by at least 20%.

As used herein, the terms "enhance" and "increase" (and grammatical variants thereof) refer to an increase in the specified parameter of at least about 1%, 2%, 3%, 4%, 5%, 10%, 15%, 20%, 25%, 30%, 35%, 40%, 45%, 50%, 55%, 60%, 65%, 70%, 75%, 80%, 85%, 90%, 95%, 100%, 125%, 150%, 175%, 200%, 250%, 300% or more.

As used herein, the terms "inhibit" and "decrease" (and grammatical variants thereof) refer to a decrease in the specified parameter of at least about 1%, 2%, 3%, 4%, 5%, 10%, 15%, 20%, 25%, 30%, 35%, 40%, 45%, 50%, 55%, 60%, 65%, 70%, 75%, 80%, 85%, 90%, 95%, 99% or more.

As used herein, the term "moist snuff composition" refers to a composition that comprises shredded, crushed, ground and/or pulverized plant tissue and that is formulated for oral use, wherein oral use comprises placing the moist snuff composition in the mouth and retaining at least a portion of the moist snuff composition in the mouth for at least about 1, 2, 3, 4, 5, 6, 7, 8, 9, 10, 11, 12, 13, 14, 15, 20, 25, 30 minutes or more As used herein, the term "whole food" refers to a foodstuff lacking additives (e.g., preservatives and dyes) and artificial substances.

All patents, patent publications, non-patent publications referenced herein are incorporated by reference in their entireties for all purposes and to the same extent as if each was specifically and individually indicated to be incorporated by reference.

The present invention provides moist snuff compositions comprising, consisting essentially of or consisting of grape tissue (e.g., skins, pulp and/or seeds) and one or more humectants. In some embodiments, the composition comprises grape tissue that has been dried, shredded, ground and/or pulverized prior to combining it with the humectant(s). Compositions of the present invention may be formulated and packaged in any suitable manner, including, but not limited to, as "loose" snuff packaged in canisters/tubs and as "portioned" snuff packaged in sachets. As shown in FIG. 1, in some embodiments, the composition 10 is packaged in a container 20 comprising one or more indicia 30 indicating that the container contains a moist snuff composition. In some such embodiments, the moist snuff composition is marketed as a healthy substitute for smokeless tobacco.

The present invention also provides methods of producing moist snuff compositions, comprising, consisting essentially of or consisting of crushing and/or pressing grapes to remove juices therefrom, drying the crushed/pressed grape tissue (i.e., the skins, pulp and seeds); removing a portion of the seeds from the dried grape tissue, grinding the dried grape tissue and combining the ground grape tissue with one or more humectants.

The present invention also provides methods of using a moist snuff composition, comprising, consisting essentially of or consisting of placing an amount of a moist snuff composition of the present invention in a subject's mouth. Compositions of the present invention may comprise tissue from any suitable type(s) of grape, including, but limited to, cultivars of *Vitis rotundifolia* (hereinafter "muscadine grapes"), *Vitis vinifera* (hereinafter "*vinifera* grapes"), *Vitis labrusca, Vitis riparia, Vitis aestivalis, Vitis rupestris, Vitis coignetiae, Vitis vulpina*, and *Vitis amurensis*. In some embodiments, the composition comprises tissue from one or more types of muscadine grape. For example, in some embodiments, the composition comprises the skins, pulp and/or seeds of African Queen, Alachua, Black Beauty, Carlos, Cowart, Darlene, Doreen, Flowers, Fry, Golden Isles, Granny Val, Ison, James, Jumbo, *Magnolia*, Memory, Mish, Nesbitt, Noble, Polyanna, Rosa, Scarlett, Scuppernong, Sugargate, Summit, Supreme, Sweet Jenny, Tara, Thomas, Triumph and/or Welder muscadine grapes.

Compositions of the present invention may comprise any suitable type of grape tissue, including, but not limited to, skins, pulp and seeds. In some embodiments, the composition is devoid or substantially devoid of vegetative tissue (e.g., leaves, stems and/or roots). Compositions of the present invention may comprise grape skins, pulp and/or seeds in any suitable amounts/ratios. In some embodiments, grape skins/pulp make up about 75% to about 100% of the grape tissue (by weight, based upon the weight of the grape tissue). In some embodiments, grape skins/pulp make up about 80% to about 95% of the grape tissue (by weight, based upon the weight of the grape tissue). In some embodiments, grape skins/pulp make up about 83% to about 90% of the grape tissue (by weight, based upon the weight of the grape tissue). In some embodiments, grape skins/pulp make up about 80%, 81%, 82% 83%, 84%, 85%, 86%, 87%, 88%, 89%, 90%, 91%, 92%, 93%, 94%, 95%, 96%, 97%, 98%, 99% or more of the grape tissue (by weight, based upon the weight of the grape tissue). In some embodiments, grape seeds make up about 0% to about 25% of the grape tissue (by weight, based upon the weight of the grape tissue). In some embodiments, grape seeds make up about 5% to about 20% of the grape tissue (by weight, based upon the weight of the grape tissue).). In some embodiments, grape seeds make up about 10% to about 17% of the grape tissue (by weight, based upon the weight of the grape tissue). In some embodiments, grape seeds make up about 20%, 19%, 18%, 17%, 16%, 15%, 14%, 13%, 12%, 11%, 10%, 9%, 8%, 7%, 6%, 5%, 4%, 3%, 2%, 1% or less of the grape tissue (by weight, based upon the weight of the grape tissue). In some embodiments, the ratio of skins/pulp to seeds in the grape tissue is in the range of about 100:1 to about 2:1 (by weight). In some embodiments, the ratio of skins/pulp to seeds in the grape tissue is the range of about 20:1 to about 3:1 (by weight). In some embodiments, the ratio of skins/pulp to seeds in the grape tissue is about 10:1, 9:1, 8:1, 7:1, 6:1, 5:1, or 4:1 (by weight).

Compositions of the present invention may comprise any suitable humectant(s), including, but not limited to, glycerin, glyceryl triacetate, propylene glycol, vinyl alcohol, polymeric polyols (e.g., polydextrose), sugar polyols (e.g., glycerol, erythritol, sorbitol, maltitol and xylitol), *quillaia*, corn syrup, honey and molasses. In some embodiments, the humectant comprises, consists essentially of or consists of honey and/or molasses. In some embodiments, honey makes up about 50% to about 95% of the humectant (by weight, based upon the weight of the humectant). In some embodiments, honey makes up about 75% to about 85% of the humectant (by weight, based upon the weight of the humectant). In some embodiments, honey makes up about 70%, 75%, 80%, 85%, 90%, 95% or more of the humectant (by weight, based upon the weight of the humectant). In some embodiments, molasses makes up about 5% to about 50% of the humectant (by weight, based upon the weight of the humectant). In some embodiments, molasses makes up about 15% to about 25% of the humectant (by weight, based upon the weight of the humectant). In some embodiments, molasses makes up about 30%, 25%, 20%, 15%, 10%, 5% or less of the humectant (by weight, based upon the weight of the humectant). In some embodiments, the ratio of honey to molasses in the humectant is about 20:1 to about 2:1. In some embodiments, the ratio of honey to molasses in the humectant is about 10:1, 9:1, 8:1, 7:1, 6:1, 5:1, 4:1, or 3:1.

As will be understood by those skilled in the art, the humectant may both provide moisture and promote the retention of moisture. In some embodiments, the humectant provides all or substantially all of the moisture in the composition.

Compositions of the present invention may comprise any suitable mix of grape tissue and humectant. In some embodiments, grape tissue makes up about 5% to about 75% of the composition (by weight, based upon the weight of the composition). In some embodiments, grape tissue makes up about 20%, 25%, 30%, 35%, 40%, 45%, 50%, 55%, 60%, 65%, 70% or more of the composition (by weight, based upon the weight of the composition). In some embodiments, humectant makes up about 25% to about 95% of the composition (by weight, based upon the weight of the composition). In some embodiments, humectant makes up about 80%, 75%, 70%, 65%, 60%, 55%, 50%, 45%, 40%, 35%, 30% or less of the composition (by weight, based upon the weight of the composition). The ratio of grape tissue to humectant may be selectively adjusted to yield compositions having differing moisture levels. In some embodiments, the ratio of grape tissue to humectant in the composition is about 10:1 to about 1:10. In some embodiments, the ratio of grape tissue to humectant in the composition is about 5:1 to about 1:5. In some embodiments, the ratio of grape tissue to humectant in the composition is about 5:1, 4:1, 3:1, 3:2, 1:1, 1:2, 2:3, 1:3, 1:4, or 1:5.

Compositions of the present invention may further comprise any suitable additive(s). For example, in some embodiments, the composition further comprises one or more abrasives (e.g., baking soda, salt, orange peel and lemon peel), one or more antioxidants and/or acidity regulators (e.g., adipate, ascorbate, citrate, erythorbate, fumarate, gallate, lactate, malate, phosphate, potassium carbonate, ammonium carbonate, ammonium sulphate, magnesium carbonate, ferrous carbonate, sodium hydroxide, potassium hydroxide, ammonium hydroxide, stannous chloride, succinate, tartrate, 4-hexylresorcinol and tocopherol), one or more anti-caking agents (e.g., mannitol, glycerol, magnesium oxide, sodium ferrocyanide, potassium ferrocyanide, calcium ferrocyanide, silicon dioxide, calcium silicate, talc, sodium aluminosilicate, zinc silicate, bentonite, aluminum silicate, potassium silicate, stearic acid and magnesium stearate), one or more colorants (e.g., curcumin, riboflavin, tartrazine, cochineal, erythrosine, indigo carmine, caustic sulphite caramel, ammonia caramel, sulphite ammonia caramel, annatto, paprika oleoresin, lycopene, beta-apo-8'-carotenal, canthaxanthin, betanin, saffron and titanium dioxide), one or more emulsifiers (e.g., lechithin and sodium stearoyl lactylate), one or more flavorants (e.g., lactic acid, glutamic, acid, monosodium glutamate, monopotassium glutamate, monoammonium glutamate, calcium diglutamate, magnesium diglutamate, guanylic acid, (di)sodium guanylate, dipotassium guanylate, calcium guanylate, inosinic acid, disodium inosinate, dipotassium inosinate, calcium inosinate, calcium 5'-ribonucleotides, disodium 5'-ribonucleotides, glycine and zinc acetate), one or more glazing agents (e.g., beeswax, carnauba wax, shellac paraffins, petroleum wax, rice bran wax, wax esters, methyl esters of fatty acids, montanic esters, oxidized polyethylene and an ester of colophony), one or more herbal supplements (e.g., alfalfa, *arnica*, bitter orange, clover, dandelion, *digitalis*, ephedra, evening primrose, feverfew, flaxseed, ginsing, ginko bilboa, guto kola, guaran, guava, kava, *lobelia*, St. John's wort, Saw palmetto, tea tree oil, white willow and yerba santa), one or more mineral supplements (e.g., calcium, chlorine, copper, iodine, iron, magnesium, phosphorous, potassium, selenium, sodium, sodium chloride and zinc), one or more preservatives (e.g., acetates, benzoates, formats, honey, lactates, nitrates, phenols, propionates, sorbates and sulphites), one or more spices (e.g., allspice, anise, black pepper, cinnamon, clove, garlic, ginger, licorice, mint, nutmeg, oregano, *sassafras*, turmeric, vanilla, white pepper and wintergreen), one or more stimulants (e.g., caffeine and nicotine), one or more sweeteners (e.g., dextrose, fructose, galactose, glucose, maltose, sucrose, honey, molasses, aspartame, cyclamate, isomalt, isomaltitol, saccharin, sucralose, alitame, thaumatin, glycyrrhizin, steviol glycosides, neotame, lactitol, mannitol and xylitol), one or more thickeners, stabilizers and/or gelling agents (e.g., alginic acid, sodium alginate, potassium alginate, ammonium alginate, calcium alginate, agar, carrageenan, guar gum, carob gum, oat gum, acacia gum, karaya gum, tragacanth, tara gum, gelan gum, xanthan gum, pectin, cellulose, methyl cellulose, ethyl cellulose, hydroxypropyl cellulose, hypromellose, ethyl methyl cellulose, carboxymethyl cellulose, ethyl hydroxyethyl cellulose, an acetic/lactic/citric acid ester of mono- and di-glycerides, sucroglyceride, polyglycerol polyricinoleate, sorbitan monostearate, sorbitan tristearate, sorbitan monolaurate, sorbitan trioleate, stearyl tartrate, stearyl citrate, arrowroot, cornstarch, katakuri starch, potato starch, sago, tapioca, sodium pyrophosphate, collagen, furcellaran and gelatin), and/or one or more vitamin supplements (e.g., ascorbic acid, biotin, beta carotene, cholecalciferol, folic acid, niacin, pantothenic acid, phylloquinone, pyridxine, riboflavin, thiamine and tocopherol).

Compositions of the present invention may comprise any suitable combination and concentration of additives. In some embodiments, the composition comprises one or more additives in an amount ranging from about 0.00001% to about 45% (by weight, based upon the weight of the composition). For example, in some embodiments, the composition comprises about 1% to about 45% herbal supplement, about 0.00001% to about 1% mineral supplements, about 0.00001% to about 1% preservatives, about 0.00005% to about 5% spices, about 0.00001% to about 5% stimulants, about 0.00001% to about 5% sweeteners and/or about 0.00001% to about 1% vitamin supplements.

Although they have thus far been described as comprising tissue from one or more types of grape, it is to be understood that compositions of the present invention may also comprise other suitable plant tissues. For example, in some embodiments, the moist snuff composition comprises dried, shredded, ground and/or pulverized tissue from one or more berries (e.g., cultivars of barberry, bearberry, blueberry, coffee berry, cranberry, crowberry, currant, elderberry, gooseberry, goji berry, honeyberry, lemon, lime, lingonberry, mangosteen, orange, pepper, persimmon, pomegranate and prune), one or more drupes (e.g., cultivars of acai, plum, peach, nectarine and cherry), one or more pomes (e.g., cultivars of apple and pear), and/or one or more aggregate fruits (e.g., cultivars of blackberry, raspberry and strawberry).

Compositions of the present invention may be devoid or substantially devoid of tobacco tissue, corn tissue and/or bean tissue.

Compositions of the present invention may be devoid or substantially devoid of vegetative tissue (e.g., leaf, root and stem tissue).

As will be understood by those skilled in the art, compositions of the present invention may comprise a variety of phytochemicals (e.g., a variety of antioxidant phytochemicals), based (at least in part) on the type(s) of plant tissues included therein.

Compositions of the present invention may comprise any suitable number/mixture of phytochemicals. For example, in some embodiments, the composition comprises one or more monophenols (e.g., apiole, carnosol, carvacrol, dillapiole and rosemarinol), one or more flavonoids (e.g., flavonols, such as quercetin, gingerol, kaempferol, myricetin, rutin and isorhamnetin; flavanones, such as hesperidin, naringenin, silybin and eriodictyol; flavones, such as acacetin, apigenin, chrysin, diosmetin, tangeritin and luteolin; flavan-3-ols, such as catechin, gallocatechin, epicatechin, epigallocatechin, epigallocatechin gallate, epicatechin 3-gallate, theaflavin-3-gallate, theaflavin-3'-gallate, theaflavin-3,3'-digallate, therarubigins and proanthocyanidins; flavan-3-nols; and anthocyanidins, such as aurantinidin, cyanidin, delphidin, europinidin, malvidin, pelargonidin, peoonidin, petunidin and rosinidin), one or more isoflavanoids (e.g, isoflavones, such as daidzein, geinstein and glycitein; isoflavanes, such as lonchocarpane and laxiflorane; isoflavandiols; isoflavenes, such as glabrene, 2-methoxyjudaicin and haginin D; and pterocarpans, such as bitucarpin A, bitucarpin B, erybraedin A, erybraedin B, erythrabyssin II, erystagallin A, erythrabissin-1, erycristagallin, glycinol, glyceollidin I, glyceollodin II, glyceollins, glycyrrhizol A, maackiain, medicarpin, morisianine, orientanol a, phaseolin, pisatin, striatine and trifolirhizin), one or more flavanolignans (e.g., silibinin, silychristin, silydianin, dehydrosilybin, deoxysilycistin, deoxysilydianin, silandrin, silybinome, silyhermin, neosilyhermin, hydnocarpin, scutellaprostin A, scutellaprostin B, scutellaprostin, C, scutellaprostin D, scutellaprostin E, scutellaprostin F, hydnowightin, palstatin, salcolin A, salcolin B and rhodiolin), one or more lignans (e.g., matairesinol, secoisolariciresinol, pinoresinol and lariciresinol), one or more stilbenoids (e.g., resveratrol, piceatannol, pinosylvin, pterostilbene, α-viniferin, ampelopsin A, ampelopsin E, diptoindonesin C, diptoindonesin F, ϵ-viniferin, flexuosol A, gnetin H, hemsleyanol D, hopeaphenol, trans-diptoindonesin B, vaticanol B, astringin, piceid and diptoindonesin A), one or more curcuminoids (e.g., demethoxycurcumin and bisdemethoxycurcumin), one or more hydrolysable tannins (e.g., castalagin, castalin, casuarictin, grandinin, punicalagin, punicalin, roburin A, tellimagrandin, terflavin B and vescalagin), one or more phenolic acids (e.g., salicylic acid, vanillin, gallic acid, ellagic acid and tannic acid), one or more hydroxycinnamic acids (e.g., caffeic acid, chlorogenic acid, cinnamic acid, ferulic acid and coumaric acid), capsaicin, one or more plant estrogens (e.g., coumestrol), one or more tyrosol esters (e.g., tyrosol, hydroxytyrosol, oleocanthal and oleuropein), one or more alkylresorcinols (e.g., olivetol, persoonol, grevillol, ardisinol I, ardisinol II, adipostatin A, adipostatin B, bilobol, hexylresorcinol, hydrobilobol, cardol, rucinol, irisresorcinol, panosialin, stemphol, R-leprosol, α-leprosol, merulinic acid and xenognosin), one or more terpenoids (e.g., phytoalexins, such as capsidiol and geraniol), one or more terpenes (e.g., carotenes, such as α-carotene, β-carotene, γ-carotene, δ-carotene, lycopene, neurosporene, phytofluene and phytoene; and xanthophylls, such as canthaxanthin, cryptoxanthin, zeaxanthin, astaxanthin, lutein and rubixanthin), one or more monoterpenes (e.g., limonene and perillyl alcohol), one or more saponins, one or more lipids (e.g., phytosterols, tocopherols, omega-3 fatty acids, omega-6 fatty acids and omega-9 fatty acids), one or more triterpenoids (e.g., oleanlic acid, ursolic acid, betulinic acid and moronic acid), one or more phytosterols (e.g., campesterol, beta sitosterol, gamma sitosterol and stigmasterol), one or more omega-3, -6 or -9 fatty acids (e.g., linoleic acid, oleic acid and alpha-linolenic acid), one or more betalains (e.g., betacyanins, such as betanin, isobetanin, probetanin and neobetanin; and betaxanthins, such as indicaxanthin and vulgaxanthin), one or more organosulfides (e.g., dithiolthiones, such as sulphoraphane; polysulfides, such as allyl methyl trisulfide; and sulfides, such as diallyl disulfide), one or more indoles, one or more protein inhibitors and/or one or more glucosinolates. In some preferred embodiments (e.g., embodiments wherein the composition comprises tissue from one or more cultivars of muscadine grape), the composition comprises ellagic acid, catechin, resveratrol, chlorogenic acid, caffeic acid, cinnamic acid, epicatechin, gallic acid, geraniol, coumaric acid, kaempferol, myricetin, quercetin, tartaric acid, pectin, cyanidin, peonidin, delphinidin, petunidin, malvidin, ascorbic acid, one or more anthocyanidins and one or more oligomeric procyanidins.

Compositions of the present invention may comprise any suitable combination and concentration of phytochemicals. In some embodiments, the composition comprises at least about 5, 10, 15, 20, 25, 30, 35, 40, 45, 50, 55, 60, 65, 70, 75, 80, 85, 90, 95, 100, 110, 120, 130, 140, 150, 160, 170, 180, 190, 200 or more distinct phytochemicals. In some embodiments, the composition comprises one or more phytochemicals in an amount ranging from about 0.01 to about 75000 μg/g. For example, in some embodiments, the composition comprises about 10, 20, 30, 40, 50, 60, 70, 80, 90, 100, 150, 200, 250, 300, 350, 400, 450, 500, 550, 600, 650, 700, 750, 800, 850, 900, 950, 1000, 1100, 1200, 1300, 1400, 1500, 1600, 1700, 1800, 1900, 2000 or more μg/g ellagic acid (e.g., about 204 μg/g ellagic acid); about 25, 50, 75, 100, 125, 150, 175, 200, 225, 250, 275, 300, 325, 350, 375, 400, 425, 450, 475, 500, 525, 550, 575, 600, 625, 650, 675, 700, 800, 900, 1000, 1100, 1200, 1300, 1400, 1500, 1600, 1700, 1800, 1900, 2000 or more μg/g gallic acid (e.g., about 306 μg/g gallic acid); about 0.1, 0.2, 0.3, 0.4, 0.5, 0.6, 0.7, 0.8, 0.9, 1, 1.5, 2, 2.5, 3, 3.5, 4, 4.5, 5, 5.5, 6, 6.5, 7, 7.5, 8, 8.5, 9, 9.5, 10 or more μg/g resveratrol (e.g., about 0.6 μg/g resveratrol); about 1, 2, 3, 4, 5, 6, 7, 8, 9, 10, 11, 12, 13, 14, 15, 16, 17, 18, 19, 20, 25, 30, 35, 40, 45, 50, 55, 60, 65, 70, 75, 80, 85, 90, 95, 100 or more μg/g catechin (e.g., about 15.08 μg/g catechin); about 500, 550, 600, 650, 700, 750, 800, 850, 900, 950, 1000, 1100, 1200, 1300, 1400, 1500, 1600, 1700, 1800, 1900, 2000, 2500, 3000, 3500, 4000, 4500, 5000, 5500, 6000, 6500, 7000, 7500 or more μg/g epicatechin (e.g., about 1081 μg/g epicatechin); about 1, 2, 3, 4, 5, 6, 7, 8, 9, 10, 15, 20, 25, 30, 35, 40, 45, 50 or more μg/g catechin gallate (e.g., about 5.2 μg/g catechin gallate); about 10, 15, 20, 25, 30, 35, 40, 45, 50, 55, 60, 65, 70, 75, 80, 85, 90, 95, 100, 125, 150, 175, 200, 225, 250, 275, 300, 325, 350, 375, 400, 425, 450, 475, 500 or more μg/g epicatechin gallate (e.g., about 53.6 μg/g epicatechin gallate); about 0.1, 0.2, 0.3, 0.4, 0.5, 0.6, 0.7, 0.8, 0.9, 1, 1.25, 1.5, 1.75, 2, 2.25, 2.5, 2.75, 3, 3.25, 3.5, 3.75, 4 or more μg/g epigallocatechin (e.g., about 0.382 μg/g epigallocatechin); about 0.01, 0.02, 0.03, 0.04, 0.05, 0.06, 0.07, 0.08, 0.09, 0.1, 0.15, 0.2, 0.25, 0.3, 0.35, 0.4, 0.45, 0.5, 0.55, 0.6, 0.65, 0.7, 0.75, 0.8, 0.85, 0.9, 0.95, 1 or more μg/g epigallocatechin gallate (e.g., about 0.094 μg/g epigallocatechin gallate); and/or about 5, 6, 7, 8, 9, 10, 11, 12, 13, 14, 15, 16, 17, 18, 19, 20, 21, 22, 23, 24, 25, 30, 35, 40, 45, 50, 55, 60, 65, 70, 75, 80, 85, 90, 95, 100 or more mg/g proanthocyanidin (e.g., about 14.172 mg/g proanthocyanidin).

Accordingly, compositions of the present invention may be used to deliver phytochemicals (e.g., a plurality of antioxidant phytochemicals) to a subject.

As will be understood by those skilled in the art, compositions comprising more phytochemicals may provide more and/or greater health benefits than compositions comprising fewer or no phytochemicals (e.g., antioxidant phytochemicals). Thus, compositions comprising muscadine grape skins, pulp and/or seeds may be particularly beneficial. See, e.g., Banini et al., Nutrition 22(11-12):1137 (2006); Farrar et al., Biofactors 30(3):193 (2007); Ghanim et al., J. Clin. Endocrinol. Metab. 96(5):1409 (2011); God et al., J. Med. Food 10(1):54 (2007); Gourineni et al., J. Agric. Food Chem. 60(31):7674 (2012); Greenspan et al., J. Agric. Food Chem. 53(22):8481 (2005); Hapner et al., Chem. Biol. INteract. 186(3):275 (2010); Hartle et al., Muscadine Medicine, Blue Heron Nutraceuticals, L L C (2005); Hudson et al., Cancer Res. 67(17):8396 (2007); Lee et al., J. Agric. Food. Chem. 53(15):6003 (2005); McDougald et al., Avian Dis. 52(4):646 (2008); Mellen et al., J. Amer. Coll. Nutrition 29(5):469 (2010); Mertens-Talcott et al., Cancer Lett. 218(2):141 (2005); Mertens-Talcott et al., J. Agric. Food Chem. 54(15):5336 (2006); Nicoletti et al., J. Agric.Food Chem. 56(19):8801 (2008); Noratto et al., J. Agric. Food Chem. 59(14):7999 (2011); O'Conner et al., Phytother. Res. 25(11):1727 (2011); Pastrana-Bonilla et al., J. Agric. Food Chem. 51(18):5497 (2003); Sandhu and Gu, J. Agric. Food Chem. 58(8):4681 (2010); Shi et al., J. Med. Food 6(4):291 (2003); Tallant et al., *Inhibition of Cancer Cell Growth by Muscadine Grape Seed and Grape Skin Extracts*, Abstract, 102nd Annual Meeting of the American Association for Cancer Research (Apr. 5, 2011); Tate et al., Cancer Lett. 212(2):153 (2004); Yi et al., J. Agric. Food Chem. 53(22): 8804 (2005); Yilmaz and Toledo, J. Agric. Food Chem. 52(2):255 (2004); You et al., J. Chromatogr. A. 1240:96 (2012); You et al., J. Food Sci. 77(10):C1115 (2012); You et al., J. Food Sci. 59(17):9506 (2011).

As noted above, compositions of the present invention may comprise any suitable combination and concentration of phytochemicals. Compositions of the present invention may possess any suitable oxygen radical absorbance capacity. In some embodiments, the composition has an oxygen radical absorbance capacity of about 50, 100, 150, 200, 250, 300, 350, 400, 450, 500, 550, 600, 650, 700, 750, 800, 850, 900, 950, 1000, 1100, 1200, 1300, 1400, 1500, 1600, 1700, 1800, 1900, 2000 or more micromole Trolox equivalents per gram (e.g., about 895 micromole Trolox equivalents per gram).

Although they have thus far been described as "moist snuff" compositions, it is to be understood that, in some embodiments, compositions of the present invention may also be formulated, packaged and marketed as a whole food, a conventional food, a food additive, a generally recognized as safe (GRAS) substance and/or a dietary supplement (collectively referred to as "foodstuffs"). Such compositions may only be administered to a subject using a method that is consistent with their use as foodstuffs and may not be used to treat and/or prevent disease.

Methods of producing compositions of the present invention may comprise, consist essentially of or consist of drying plant tissue (e.g., tissue from one or more types of muscadine grape); shredding, crushing, grinding and/or pulverizing the plant tissue; and combining the shredded, crushed, ground and/or pulverized plant tissue with a humectant to produce a composition (e.g., a moist snuff composition). The plant tissue may be crushed and/or pressed to remove juices therefrom prior to drying. The plant tissue may be frozen and stored prior to crushing, pressing and/or drying. Portions of the plant tissue (e.g., a portion of the seeds) may be removed prior to shredding, crushing, grinding and/or pulverizing the plant tissue. Thus, in some embodiments, methods of the present invention comprise, consist essentially of or consist of harvesting one or more types of grape (e.g., one or more cultivars of muscadine grape), crushing and/or pressing the harvested grapes to remove juices and/or oils therefrom, drying the crushed/pressed grapes (i.e., the grape skins, pulp and seeds that remain after crushing/pressing); removing substantially all of the seeds from the dried grapes, grinding the remaining grape tissue and combining the ground grape tissue with one or more humectants (e.g., honey and molasses) to form a moist snuff composition.

Any suitable method/device may be used to harvest fresh plant tissue for use in methods of the present invention. In some embodiments, the plant tissue is hand-picked. In some embodiments, the plant tissue is harvested with a mechanical harvester.

Any suitable method/device may be used to freeze the plant tissue, including, but not limited to, freeze drying and flash freezing. Plant tissue may be frozen and stored at any suitable temperature. In some embodiments, the plant tissue is frozen and stored at a temperature ranging from about 0° F. to about −50° F. In some embodiments, the plant tissue is frozen and stored at or below about 0° F., −5° F., −10° F., −15 F°, −20° F., −25° F., −30° F., −35° F., −40° F., −45° F., or −50° F. Plant tissue (e.g., frozen plant tissue) may be stored for any suitable period of time. In some embodiments, frozen plant tissue is stored for about 30 to about 210 days before further processing. In some embodiments, frozen plant tissue is stored for about 45, 60, 75, 90, 100, 110, 120, 130, 140, 150, 160 170, 180 days or more before further processing.

Any suitable method/device may be used to crush and/or press the plant tissue to remove juices therefrom. In some embodiments, the plant tissue is manually crushed/pressed. In some embodiments, the plant tissue is crushed/pressed with a mechanical crusher/presser (e.g., a motorized crusher/destemmer, a basket press, a moving-head press, a bladder press, a membrane press, a screw press, an impulse press, or a belt press). In some embodiments, about 80% to about 99% of the juice is removed from the plant tissue upon crushing and/or pressing. In some embodiments, about 85% to about 95% of the juice is removed from the plant tissue upon crushing and/or pressing. In some embodiments, at least about 85% 86%, 87%, 88%, 89%, 90%, 91%, 92%, 93%, 94%, 95%, 96%, 97%, 98%, 99% or more of the juice is removed from the plant tissue upon crushing and/or pressing. In some embodiments, about 150 gallons to about 200 gallons of juice is removed per ton of plant tissue. In some embodiments, at least about 150, 155, 160, 165, 170, 175, 180, 185, 190, 195, 200 or more gallons of juice is removed per ton of plant tissue.

Any suitable method/device may be used to dry the plant tissue. In some embodiments, the plant tissue is sun-dried. In some embodiments, the plant tissue is dried with a mechanical dehydrator (e.g., a forced air dehydrator). In some embodiments, about 60% to about 100% of the moisture is removed from the plant tissue upon drying. In some embodiments, about 80% to about 95% of the moisture is removed from the plant tissue upon drying. In some embodiments, at least about 85% 86%, 87%, 88%, 89%, 90%, 91%, 92%, 93%, 94%, 95%, 96%, 97%, 98%, 99% or more of the moisture is removed from the plant tissue upon drying.

Any suitable method/device may be used to remove seeds from the plant tissue. In some embodiments, the seeds are manually removed. In some embodiments, the seeds are removed with a mechanical seed remover (e.g., a mechanical clarifier). In some embodiments, all or substantially all of the seeds are removed from the plant tissue. In some embodiments, about 60% to about 95% of the seeds are removed from the plant tissue. In some embodiments, at least about 80%, 81%, 82%, 83%, 84%, 85% 86%, 87%, 88%, 89%, 90%, 91%, 92%, 93%, 94%, 95%, 96%, 97%, 98%, 99% or more of the seeds are removed from the plant tissue.

Any suitable method/device may be used to grind the plant tissue. In some embodiments, the plant tissue is manually ground (e.g., with a mortar and pestle). In some embodiments, the plant tissue is ground with a mechanical grinder, (e.g., a FitzMill® grinder fitted with a screen having a nominal sieve opening of about 0.05 mm to about 5 mm). In some embodiments, the plant tissue is ground until the average particle size of the plant tissue is in the range of about 0.05 mm to about 5 mm. In some embodiments, the plant tissue is ground until the average particle size of the plant tissue is in the range of about 0.5 mm to about 2.5 mm. In some embodiments, the plant tissue is ground until the average particle size of the plant tissue is about 2.38 mm, 2 mm, 1.68 mm, 1.41 mm, 1.19 mm, 1 mm, 0.841 mm, 0.707 mm, 0.595 mm, 0.5 mm or less.

Any suitable method/device may be used to combine the ground plant tissue and the humectant. In some embodiments, the ground plant tissue and the humectants are combined using a mechanical mixer. In some embodiments, the humectant is heated prior to, concurrently with and/or subsequent to combining the ground plant tissue and the humectant. In some embodiments, the humectant is heated to a temperature in the range of about 175° F. to about 225° F. In some embodiments, the humectant is heated to a temperature in the range of about 190° F. to about 210° F. In some embodiments, the humectant is heated to about 191° F., 192° F., 193° F., 194° F., 195° F., 196° F., 197° F., 198° F., 199° F., 200° F., 201° F., 202° F., 203° F., 204° F., 205° F., 206° F., 207° F., 208° F., 209° F., 210° F. or more. In some embodiments, the humectant is heated to just below its boiling point (i.e., the humectant is not boiled). In some embodiments, the plant tissue and humectant are combined in a plant tissue to humectant ratio of about 10:1 to about 1:10. In some embodiments, the plant tissue and humectant are combined in a plant tissue to humectant ratio of about 5:1 to about 1:5. In some embodiments, the plant tissue and humectant are combined in a plant tissue to humectant ratio of about 5:1, 4:1, 3:1, 3:2, 1:1, 1:2, 2:3, 1:3, 1:4, or 1:5.

Any suitable additive(s) may be included in the composition, including, but not limited to, those discussed above with respect to compositions of the present invention. In some embodiments, one or more additives is/are added to the composition after the ground plant tissue and humectant are combined. In some embodiments, one or more additives is/are combined with the ground plant tissue prior to combining it with the humectant. In some embodiments, one or more additives is/are combined with the humectant prior to combining it with the ground plant tissue. In some embodiments, one or more additives is/are combined with the plant tissue prior to grinding the plant tissue. In some embodiments, one or more additives is/are combined with the plant tissue prior to drying the plant tissue. In some embodiments, one or more additives is/are combined with the plant tissue prior to crushing and/or pressing the plant tissue.

The composition may be packaged in any suitable container or packaging, including, but not limited to, canisters, tubs, and sachets. In some embodiments, the composition is formulated as "loose" snuff packaged in canisters/tubs. In some embodiments, the composition is formulated as "portioned" snuff packaged in sachets. The container/package may be airtight and may comprise one or more indicia indicating that the container/package contains a moist snuff composition. In the some embodiments, the container/package comprises one or more indicia indicating that the composition may be used as a substitute for smokeless tobacco.

Any suitable amount of the composition may be placed in the container/package. In some embodiments, the container/package contains between about 10 grams and about 100 grams of the composition and/or between about 5 and about 50 centiliters of the composition. For example, in some embodiments, about 20, 25, 30, 35, 40, 45, 50, 55, 60, 65, 70, 75 grams or more of the composition is packaged in a container such as the one depicted in FIG. 1.

Methods of using compositions of the present invention may comprise, consist essentially of or consist of placing the composition in the mouth. In some embodiments, the composition remains in the mouth for at least about 1, 2, 3, 4, 5, 6, 7, 8, 9, 10, 11, 12, 13, 14, 15, 20, 25, 30 minutes or more.

Methods of using compositions of the present invention may further comprise ingesting some or all of the composition. In some embodiments, the entire composition is ingested. In some embodiments, a portion of the composition is ingested and a portion of the composition is retained in the mouth for a specified period of time (e.g., about 1, 2, 3, 4, 5, 6, 7, 8, 9, 10, 11, 12, 13, 14, 15, 20, 25, 30 minutes or more) and then discarded.

EXAMPLES

The following examples are for illustrative purposes only and are not intended to be a detailed catalogue of all the different ways in which the present invention may be implemented or of all the features that may be added to the present invention. One skilled in the art will therefore appreciate that the following Examples are exemplary and that numerous changes, modifications, and alterations can be employed without departing from the scope of the presently disclosed subject matter.

Example 1

Moist Snuff Composition Comprising Muscadine Grape Seeds/Skins

Muscadine grapes (Carlos, Cowart, *Magnolia* and/or Noble muscadine grapes) were harvested and pressed to remove substantially all of the juice therefrom. The pressed grapes were stored at about −22° F. for approximately 180 days, then thawed and dried to remove approximately 92% of the moisture therefrom (moisture content was measured using a Farmex™ MT-Pro moisture tester, (Part no. 08125, Farmcomp Oy, Tuusula, Finland). The pressed/dried grapes were clarified to separate the skins from the seeds (seeds were removed from the skins using a custom-made clarifier). Approximately 15% of the seeds remained entrapped within the skins. The pressed/dried skins (and the entrapped seeds) were ground to an average particle size of about 1.63 mm using a FitzMill® SPV-DKAS012 grinder fitted with a screen having a nominal sieve opening of 1.63 mm. The ground skins/seeds were combined with a pre-heated (about 212° F.) mixture of honey and molasses (approximately 3 parts honey per 1 part molasses) at a ratio of about 4 parts honey/molasses mixture per 1 part ground skins/seeds (by weight).

Example 2

Moist Snuff Composition Comprising Muscadine Grape Seeds/Skins

Muscadine grapes (Carlos, Cowart, *Magnolia* and/or Noble muscadine grapes) are harvested and pressed to remove substantially all of the juice therefrom. The pressed grapes are stored at about −20° F. for approximately 180 days, then thawed and dried to remove approximately 90% of the moisture therefrom (moisture content is measured using a Farmex™ MT-Pro moisture tester, (Part no. 08125, Farmcomp Oy, Tuusula, Finland). The pressed/dried grapes are clarified to separate the skins from the seeds (seeds are removed from the skins using a custom-made clarifier). Approximately 10% of the seeds remain entrapped within the skins. The pressed/dried skins (and the entrapped seeds) are ground to an average particle size of about 1.63 mm using a FitzMill® SPV-DKAS012 grinder fitted with a screen having a nominal sieve opening of 1.63 mm. The ground skins/seeds are combined with pre-heated (about 210° F.) honey at a ratio of about 2 parts honey mixture per 3 part ground skins/seeds (by weight).

Although the present invention has been described with reference to specific details of certain embodiments thereof, it is not intended that such details should be regarded as limitations upon the scope of the invention except as and to the extent that they are included in the accompanying claims. As noted above, the above-described embodiments can be modified or varied without departing from the present invention. It is therefore to be understood that, within the scope of the claims and their equivalents, the present invention can be practiced otherwise than as specifically described above.

The invention claimed is:

1. A moist snuff composition, comprising:

muscadine grape tissue in an amount of about 5% to about 50% by weight; and a humectant in an amount of about 50% to about 95% by weight, wherein the muscadine grape tissue comprises tissue from muscadine grape skins and muscadine grape pulp, or from muscadine grape skins, muscadine grape pulp and muscadine grape seeds, and the humectant consists of glycerin, glyceryl triacetate, propylene glycol, vinyl alcohol, polymeric polyols, polydextrose, sugar polyols, glycerol, erythritol, sorbitol, maltitol, xylitol, *quillaia*, corn syrup, honey, molasses, or any combination thereof.

2. The composition of claim 1, wherein the muscadine grape tissue comprises dried and ground muscadine grape skins.

3. The composition of claim 1, wherein the muscadine grape tissue comprises dried and ground muscadine grape seeds.

4. The composition of claim 1, wherein the humectant is honey.

5. The composition of claim 1, wherein the humectant is molasses.

6. The composition of claim 1, wherein the humectant is about 50% to about 95% honey and about 5% to about 50% molasses, of the total weight of the humectant.

7. The composition of claim 1, wherein the humectant is about 75% honey and about 25% molasses, of the total weight of the humectant.

8. The composition of claim 1, wherein the composition comprises about 20%-40% muscadine grape tissue and about 60%-80% humectant, by weight.

9. The composition of claim 1, wherein the composition comprises about 200 μg/g ellagic acid, about 300 μs/g gallic acid, about 0.6 μg/g resveratrol, about 15 μg/g catechin, about 1080 μg/g epicatechin, about 5 μg/g catechin gallate, about 54 μg/g epicatechin gallate, about 0.4 μg/g epigallocatechin, about 0.01 μg/g epigallocatechin gallate, and/or about 14 mg/g proanthocyanidin.

10. The composition of claim 1, wherein the composition further comprises dried, shredded, ground and/or pulverized tissue from one or more berries, one or more drupes, one or more pomes, one or more aggregate fruits, and/or any combination thereof.

11. The composition of claim 10, wherein the one or more berries are selected from barberry, bearberry, blueberry, coffee berry, cranberry, crowberry, currant, elderberry, gooseberry, goji berry, honeyberry, lemon, lime, lingonberry, mangosteen, orange, pepper, persimmon, pomegranate and prune; the one or more drupes are selected from acai, plum, peach, nectarine and cherry; the one or more pomes are selected from apple and pear; and/or the one or more aggregate fruits are selected from blackberry, raspberry and strawberry.

12. The composition of claim 1, wherein the composition further comprises dried, shredded, ground and/or pulverized tissue from strawberry and/or apple.

13. The moist snuff composition of claim 2, wherein the dried and ground muscadine grape skins are ground to a particle size of about 0.5 mm to about 5 mm.

14. The moist snuff composition of claim 3, wherein the dried and ground muscadine grape seeds are ground to a particle size of about 0.5 mm to about 5 mm.

15. A method of producing a moist snuff composition, comprising:

combining ground muscadine grape tissue in an amount of about 5% to about 50% by weight with a humectant in an amount of about 50% to about 95% by weight to produce a moist snuff composition, wherein the ground muscadine grape tissue comprises ground muscadine grape skins and ground muscadine grape pulp, or ground muscadine grape skins, ground muscadine grape pulp and ground muscadine grape seeds, and the humectant consists of glycerin, glyceryl triacetate, propylene glycol, vinyl alcohol, polymeric polyols, polydextrose, sugar polyols, glycerol, erythritol, sorbitol, maltitol, xylitol, *quillaia*, corn syrup, honey, molasses, or any combination thereof.

16. The method, of claim 15, further comprising:

grinding dried ground muscadine grape skins and ground muscadine grape pulp or grinding dried muscadine grape skins, muscadine grape pulp and muscadine grape seeds to produce the ground muscadine grape tissue.

17. The method of claim 16, further comprising:

drying muscadine grape skins and muscadine grape pulp or drying muscadine grape skins, grape pulp and muscadine grape seeds to produce the dried muscadine grape skins and muscadine grape muscadine pulp or the dried muscadine grape skins, muscadine grape pulp and muscadine grape seeds.

18. The method of claim 17, further comprising:

crushing and/or pressing muscadine grapes to separate muscadine grape juice from the muscadine grape skins, muscadine grape pulp and/or muscadine grape seeds.

19. The method of claim 15, wherein the humectant is honey.

20. The method of claim 15, wherein the humectant is molasses.

21. The method of claim 15, wherein the humectant is about 50% to about 95% honey and about 5% to about 50% molasses, by weight.

22. The method of claim 15, wherein the humectant is about 75% honey and about 25% molasses of the total weight of the humectant.

23. The method of claim 15, wherein the composition comprises about 20%-40% muscadine grape tissue and about 60%-80% humectant, by weight.

24. The method of claim 15, wherein the moist snuff composition comprises about 200 μg/g ellagic acid, about 300 μg/g gallic acid, about 0.6 μg/g resveratrol, about 15 μg/g catechin, about 1080 μg/g epicatechin, about 5 μg/g catechin gallate, about 54 μg/g epicatechin gallate, about 0.4 μg/g epigallocatechin, about 0.01 μg/g epigallocatechin gallate, and/or about 14 mg/g proanthocyanidin.

25. The method of claim 15, further comprising:

combining dried, shredded, ground and/or pulverized tissue from one or more berries, one or more drupes, one or more pomes, one or more aggregate fruits, and/or any combination thereof with the moist snuff composition.

26. The method of claim 25, wherein the berries are selected from barberry, bearberry, blueberry, coffee berry, cranberry, crowberry, currant, elderberry, gooseberry, goji berry, honeyberry, lemon, lime, lingonberry, mangosteen, orange, pepper, persimmon, pomegranate and prune; the drupes are selected from acai, plum, peach, nectarine and cherry; the pomes are selected from apple and pear and/or the aggregate fruits are selected from blackberry, raspberry and strawberry.

27. The method of claim 15, further comprising, combining dried, shredded, ground and/or pulverized tissue from strawberry and/or apple with the moist snuff composition.

28. The method of claim 16, wherein the ground muscadine grape tissue comprises a particle size of about 0.5 mm to about 5 mm.

* * * * *